United States Patent [19]

Salomon

[11] 4,191,395

[45] Mar. 4, 1980

[54] SKI BOOT ELEMENT

[75] Inventor: Georges P. J. Salomon, Annecy, France

[73] Assignee: Etablissements Francois Salomon et Fils, Annecy, France

[21] Appl. No.: 830,244

[22] Filed: Sep. 2, 1977

[30] Foreign Application Priority Data

Sep. 3, 1976 [FR] France ..... 76 26686

[51] Int. Cl.[2] ..... A63C 9/08

[52] U.S. Cl. ..... 280/613; 280/618

[58] Field of Search ..... 280/613, 618, 617, 636, 280/634, 633, 611, 607, 623; 36/117

[56] References Cited

U.S. PATENT DOCUMENTS

| | | | |
|---|---|---|---|
| 2,788,981 | 4/1957 | Emerson | 280/623 |
| 3,825,273 | 7/1974 | Greene | 280/618 |
| 3,834,723 | 9/1974 | Erlebach | 280/613 |
| 3,869,136 | 3/1975 | Jackson | 280/613 |
| 3,918,732 | 11/1975 | Wulf | 280/618 |
| 3,931,980 | 1/1976 | Marker | 280/613 |
| 3,957,280 | 5/1976 | Turnheim et al. | 280/613 |

FOREIGN PATENT DOCUMENTS

| | | | |
|---|---|---|---|
| 1428907 | 5/1969 | Fed. Rep. of Germany | 280/618 |

*Primary Examiner*—Joseph F. Peters, Jr.
*Assistant Examiner*—Milton L. Smith
*Attorney, Agent, or Firm*—Pollock, Vande Sande & Priddy

[57] ABSTRACT

A ski-boot element is connected to a boot and comprises a depression in which is located a pivot running towards the lower surface of the element. The depression receives a block integral with the ski, while locking means assure that the boot is held to the ski. Also the depression may be in a plate attached at least temporarily under the sole of the boot.

15 Claims, 6 Drawing Figures

1
4
3
2
21
10
24a
5a
13
e
6
24b
11
9
7
5
8
12

9
22
5
3
6
14
8
X
X'
7
21
13
10
3

T
40
45
43
41
48
5
53
50
5
46
22'
47

54
46
22'
T
44
41
49
53
40
42
47
50

SKI BOOT ELEMENT

The present invention relates to a ski-boot element which is either an integral part of the boot (for example, of the sole thereof) or is secured at least temporarily thereto (for example, a plate) and is designed to cooperate with a safety binding which holds the boot to the ski and frees the ski in the event of a safety release.

Certain designers have suggested bindings whereby the ski is fitted by rotating the foot: the skier places his boot across the ski and then turns it in order to align it with the longitudinal axis of the ski, in which position the boot is locked to the ski.

According to the invention, and in order to facilitate the fitting of this type of binding, a depression in an element of the boot (the sole of the boot or a plate temporarily secured thereto) designed to cooperate with a block secured to the ski, contains a projecting pivot running substantially at right angles to the supporting surface of the boot element and towards it. When the boot is resting upon the ski, the pivot is designed to cooperate with a cavity in the upper surface of the block secured to the ski, the cavity being preferably in the form of a port running in the direction of the longitudinal axis of the ski and being slightly wider than the pivot.

Figure 1:
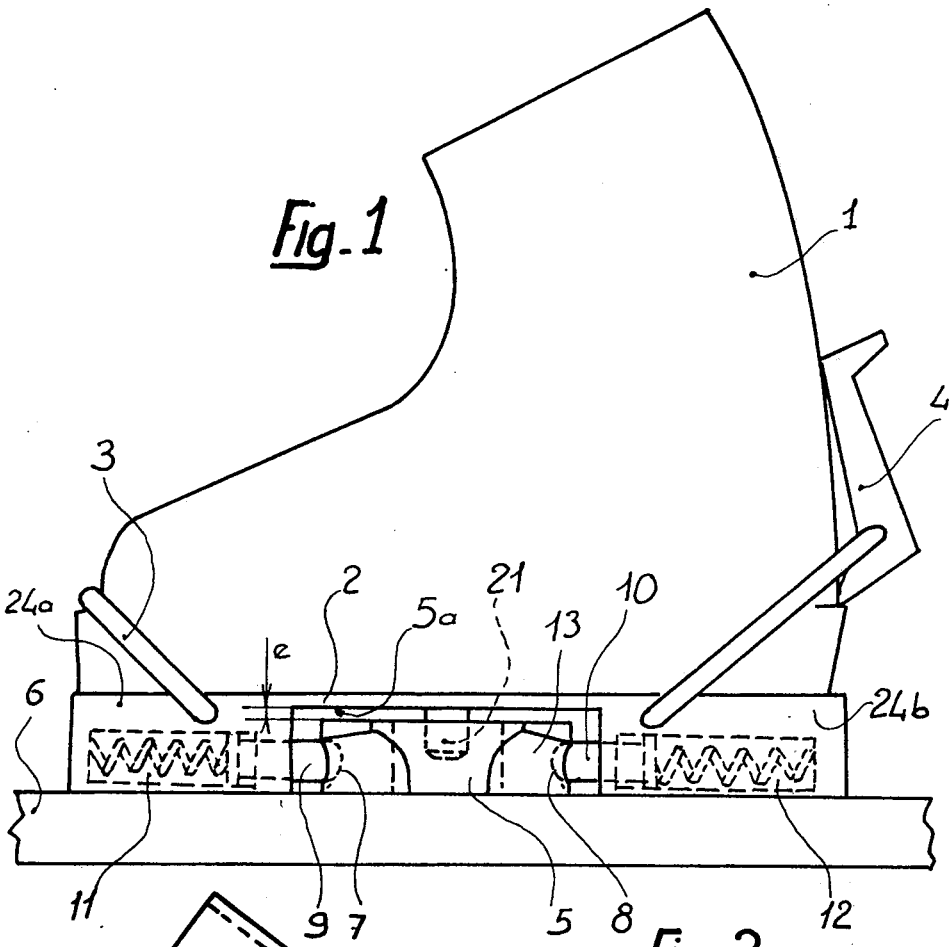
Figure 2:
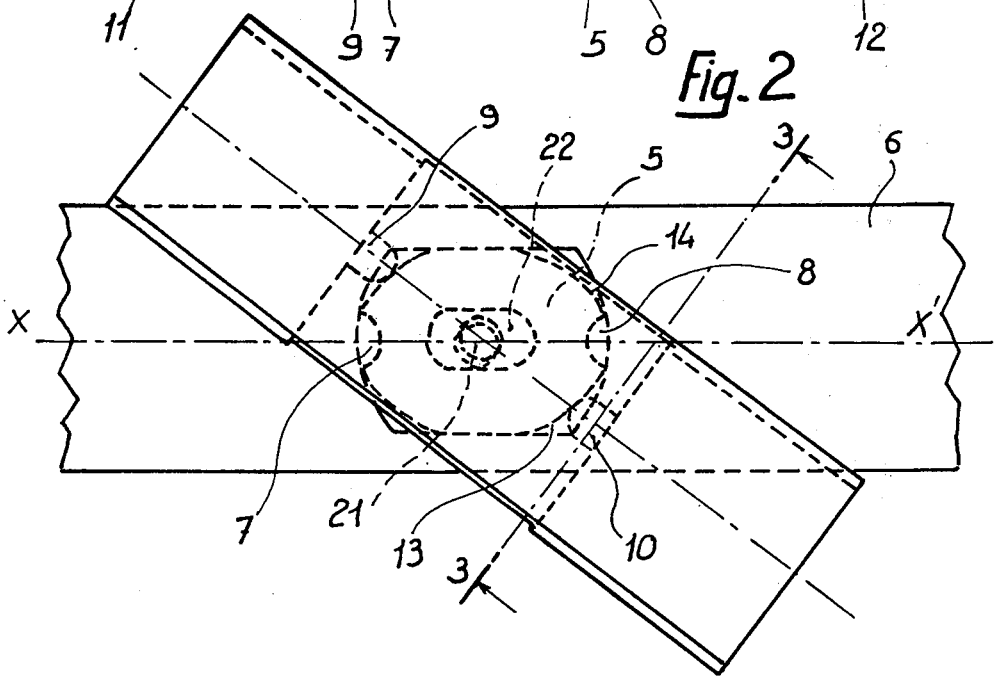
Figure 1A:
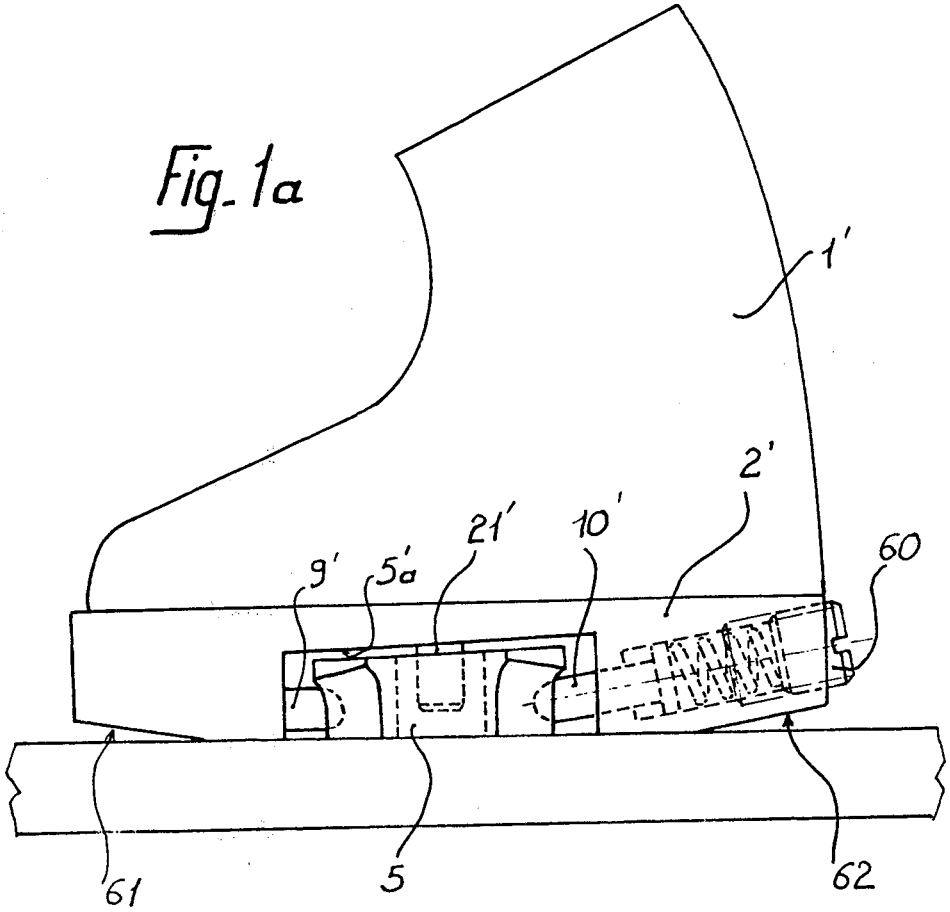
Figure 3:
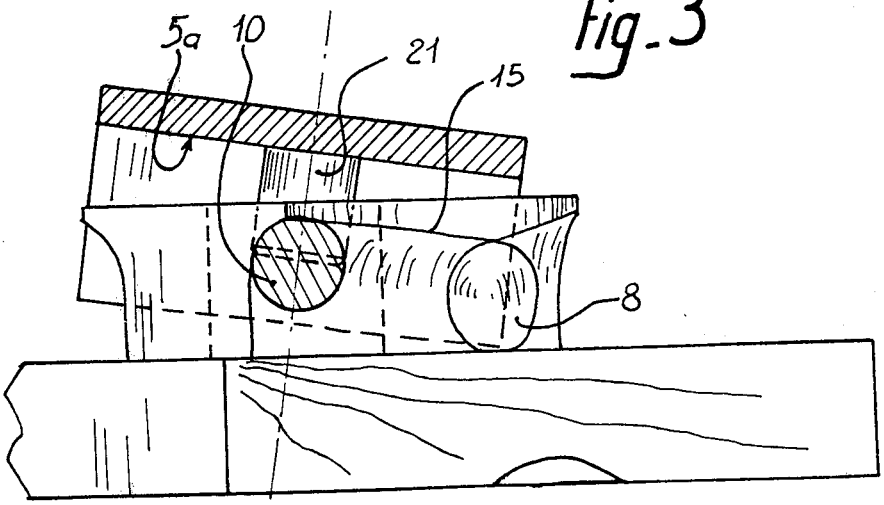
Figure 4:
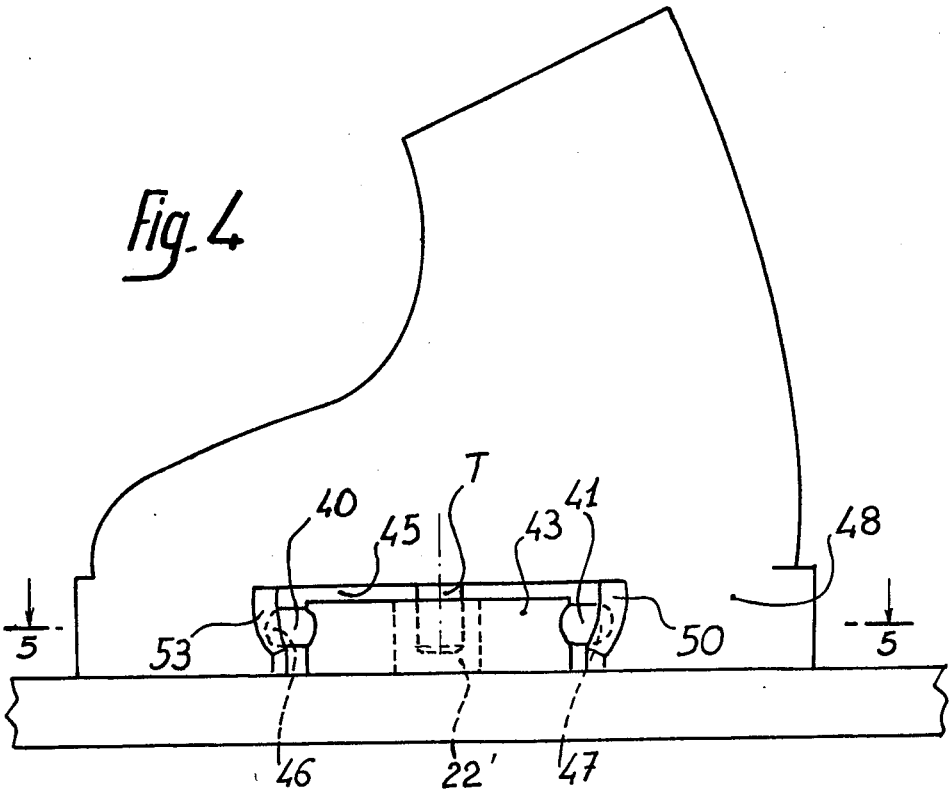
Figure 5:
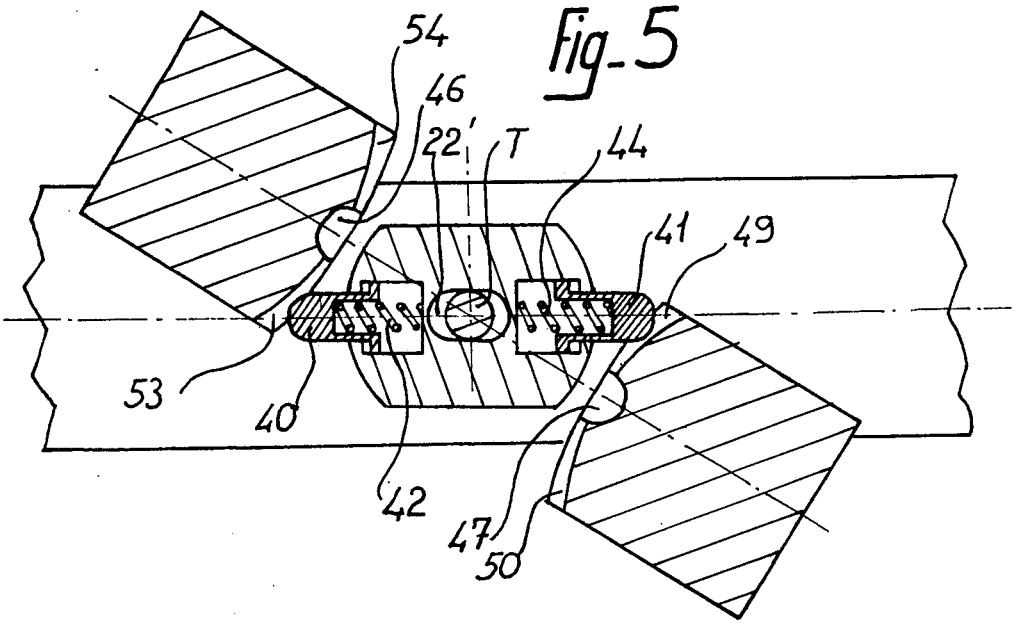

The invention will now be described with reference to the accompanying drawings wherein several embodiments are shown for purposes of illustration, and wherein:

FIG. 1 is a side elevation of one embodiment of the invention, with the ski fitted to the boot, applied to a plate fitted under the boot;

FIG. 1*a* is a variant of the embodiment illustrated in FIG. 1, in which the sole of the boot is in direct contact with the ski, with no intermediate plate;

FIG. 2 is a plan view of the binding according to FIG. 1 shown in the process of being fitted, with the boot removed;

FIG. 3 is a section along line 3—3 in FIG. 2, to an enlarged scale; and FIGS. 4 and 5 are a side elevation and a section (along line 5—5 in FIG. 4) respectively of a variant of the invention.

For reasons of simplicity, similar elements bear the same reference numerals in the following description.

In the embodiment illustrated in FIGS. 1, 2 and 3, 1 is a boot to which a plate 2 is secured, in such a manner as to form a unit therewith, by front and rear means 3 and 4 of a known type which will not be described here in detail. It will be sufficient to point out that the means of attachment are detachable in order that the boot and the plate may be taken apart when these components are not being used for skiing. In this design, safety releases occur between the plate and the ski. In the event of a fall, therefore, the boot and the plate remain attached to each other.

Located upon the upper surface of ski 6, and upon longitudinal axis XX' thereof, is a block 5 which cooperates with a depression 5*a* in the lower surface of plate 2, in an area corresponding substantially to the plantar arch of the skier's foot. This depression 5*a*, which, in the example illustrated, is a notch opening out of the sides of the plate, is higher and longer than block 5. Block 5, the walls of which are in the form of an arc, also comprises two locking housings 7,8 in alignment with longitudinal axis XX', the housings being designed to cooperate with movable pistons 9,10 arranged in ducts in parts 24*a*,24*b* of plate 2 and in alignment with longitudinal axis XX' of the plate. Pistons 9,10 are caused to project into depression 5*a* by springs housed in ducts 11,12. In the position illustrated in FIG. 1, which is the normal position of retention of the boot to the ski, the rounded ends of pistons 9,10 engage in housings 7,8 in block 5, thus locking the plate and the boot in relation to the ski. Lateral and vertical safety releases and produced by the retraction of one or both of pistons 9,10 against the action of the spring, or springs.

As may be gathered from FIGS. 1 to 3, two guide ramps 13,14 are arranged in block 5 on each side of rear housing 8. These ramps are preferably symmetrical in relation to the longitudinal axis of the ski and are such that, in fitting the ski, with the boot in the position shown in FIG. 2, they allow piston 10 to be moved automatically to corresponding housing 8. An identical arrangement is provided for piston 9. To this end, ramps 13,14, which, as may be seen in FIG. 3, are concave, are of a helicoidal configuration such that edge 15 formed by the intersection of one of the ramps with outer wall 5*c* of the block, slopes towards the upper surface of the ski and towards housing 8. It should be noted that although, in the example illustrated, edge 15 is in the form of a helix, any other curve could be used as long as it produces the same result.

The upper surface of block 5 has an oblong cavity 22 running along longitudinal axis XX' of the ski. Moreover, a cylindrical pivot runs vertically from the lower surface of depression 5*a*, the pivot being designed to engage in cavity 22, the width of which is slightly larger than the diameter of the pin. This makes it possible for play to exist between the pivot and cavity 22, but along axis XX' of the ski and at right angles thereto. This cooperation between the pivot and the cavity makes it easier for the skier to place his boot on block 23 when he places it across the ski. This, therefore, is an arrangement which makes it easier to fit the ski. Furthermore, this play between pivot 21 and cavity 22 naturally allows the lower surface of the boot to present itself at an angle to the upper surface of the ski. It is, of course, possible for the cavity to be of a different shape, circular, for example, and for there to be no play. In addition to this, the existence of pivot 21 makes it possible to impose upon the ski a specific trajectory in the event of a safety release.

In the foregoing embodiment, it is the lower surface of the plate that is in contact with the upper surface of the ski. A space e (FIG. 1) is therefore provided between the upper surface of block 5 and the lower surface of depression 5*a*, to prevent these two surfaces from bearing against each other, but another arrangement would be possible, without departing from the scope of the invention. For example, the lower surface of depression 5*a* might bear against the upper surface of block 5, but in this case it would be necessary to prevent the lower surfaces of the front and rear parts of the plate from bearing against the ski; in fact, these surfaces would have to be spaced therefrom.

FIG. 1*a* illustrates a variant in which, as already mentioned, there is no intermediate plate temporarily attached under the boot. In this case, sole 2' of boot 1' has a depression 5'*a* in its lower surface designed to cooperate with block 5. Furthermore, a pivot 21' is provided in the upper surface of depression 5'*a*, the pivot running in the direction of the ski and, when the ski is being fitted, entering into cavity 22 under block 5.

Finally, locking elements 9', 10', similar to pistons 9,10 in FIGS. 1 to 3, are provided in the vertical surfaces facing depression 5'a. The operation of this arrangement is identical with that described in connection with FIGS. 1 to 3. In this embodiment, however, the advantage is that only piston 10' is spring-loaded. Element 9' is a projecting part which is stationary in relation to the sole. It will also be noted that the sole has a front chamfer 61 and a rear chamfer 62. The upper part of block 5, and the bottom of depression 5'a, slope in an inclined plane forwardly in relation to the plane of the ski. It will also be observed that the axis of piston 10 slopes forwardly. Here again, a general arrangement of this kind makes it easier to fit the ski.

Finally, as illustrated in FIGS. 4 and 5, it would be possible, as a variant of the preceding embodiments, to arrange pistons 40,41 in longitudinal ducts in a block 43 secured to the ski, with springs 44 and 42 causing the pistons to project outwardly.

Housings 46,47, designed to cooperate with the pistons, are arranged in the front and rear surfaces of notch 45 in the plate or in sole 48 of the boot.

In FIGS. 4 and 5, locking housings 46,47 are arranged in notch 45, guide ramps 49,50 and 53,54 being associated with the housings. To this end, the walls of the notch are convex, the structure in this case being identical with that in the area of the block in the preceding embodiments.

Moreover, a pivot T, similar to that shown in FIGS. 1 to 3, is provided in the upper surface of depression 45, the pivot extending substantially vertically towards the ski when the boot is in the position for fitting to the ski. This pivot T cooperates with an oblong cavity 22' similar to cavity 22 in FIGS. 1 to 3.

It is to be understood that, without departing from the scope of the invention, it would be possible for one of the two pistons (9 or 10, 40 and 41) of the retention means to be in the form of a fixed, non-retractable, projection, the other piston still being spring-loaded. In a similar manner, it would also be possible to provide any number n of pistons (n being more than 2), and any other kind of locking elements, such as pivoting jaws, pivoting fingers, etc.

Furthermore, according to a preferred arrangement applicable to all of the embodiments, the pivot may be arranged equidistantly from the projecting parts 9,10; 9',10'; 40,41) of the locking system.

What is claimed is:

1. A ski-boot element attached at least temporarily to a boot during skiing and designed to be held to a ski, comprising (a) a depression arranged substantially in the central area of said element and extending transversely under the skier's foot the open out on both sides of the said element;

(b) front and rear parts of said element located at opposed ends of said depression, at least one of said parts having means for locking said element on said ski, said locking means being directed towards the interior of said depression and being designed to cooperate with a corresponding locking part fixed to the said ski; and (c) a projecting pivot extending from the bottom of said depression towards the lower surface of said element and substantially perpendicularly thereto, said pivot being located between said at least one locking means and the opposed one of said parts and cooperating, when said ski is being fitted, with a cavity in the locking part fixed to said ski, said cavity receiving said pivot in a rotatable relationship.

2. A boot element according to claim 1, wherein said pivot is cylindrical.

3. A ski-boot element according to claim 1, wherein both said front and rear parts have locking means and said pivot is equidistant from the respective locking means carried by said front and rear parts.

4. A ski-boot element according to claim 1, wherein said locking part fixed to the ski comprises a locking block integral with said ski.

5. A ski-boot element according to claim 1, wherein said locking part fixed to the ski comprises a locking block integral with said ski, said locking means of said element comprising projections directed towards the interior of said depression, at least one of said projections being movable and spring-loaded, said projection cooperating with at least one housing provided in said block for locking said element in position upon said ski.

6. A ski-boot element according to claim 5, wherein said housing in said block is associated with at least one guide ramp with which at least one of said projections cooperates when the boot is being fitted.

7. A ski-boot element according to claim 1, wherein said locking means carried by at least a part of said element comprises at least one housing and at least one ramp, associated with said housing, provided in a vertical wall of said depression, for locking said element in position upon said ski when the latter is being fitted.

8. A ski-boot element according to claim 7, wherein one housing and at least one ramp associated with such housing are provided in each of the two vertical walls facing said depression.

9. A ski-boot element according to claim 7, wherein said locking part fixed to the ski comprises, a locking block integral with the ski said locking block having a resilient locking system with which the associated housings and ramps of the element cooperate, said locking system including at least one movable, spring-loaded piston located in said block.

10. A ski-boot element attached at least temporarily to a boot during skiing and designed to be held to a ski, comprising;

(a) a depression arranged substantially in the central area of said element and under the skier's foot;

(b) front and rear parts of said element located at opposed ends of said depression, at least one of said parts having therein a movable, spring-loaded piston projecting into the interior of said depression and cooperating with a corresponding locking part fixed to said ski; and (c) a projecting pivot extending from the bottom of said depression towards the lower surface of said element and substantially perpendicularly thereto, said pivot being located between said spring loaded piston and the opposed one of said parts and cooperating, when said ski is being fitted, with a cavity in the locking part fixed to said ski, said cavity receiving said pivot in a rotatable relationship.

11. A ski-boot element attached at least temporarily to a boot during skiing and designed to be held to a ski, comprising (a) a depression arranged substantially in the central area of said element and under the skier's foot;

(b) front and rear parts of said element located at opposed ends of said depression, each of said parts having therein one movable, spring-loaded piston projecting into the interior of said depression, said pistons being in alignment with the longitudinal axis of said element and cooperating with a corresponding locking part fixed to said ski; and (c) a projecting pivot extending from the bottom of said depression towards the lower surface of said element and substantially perpendicularly thereto, said pivot being located between said two spring-loaded pistons and cooperating, when said ski is being fitted, with a cavity in the locking part fixed to said ski, said cavity receiving said pivot in a rotatable relationship.

12. A ski-boot element attached at least temporarily to a boot during skiing and designed to be held to a ski, comprising (a) a depression arranged substantially in the central area of said element and under the skier's foot;

(b) front and rear parts of said element located at opposed ends of said depression, one of said parts having therein a spring-loaded piston projecting into the interior of said depression, while the other parts comprises a fixed projection projecting into the interior of said depression; and (c) a projecting pivot extending from the bottom of said depression towards the lower surface of said element and substantially perpendicularly thereto, said pivot being located between said movable, spring-loaded piston and said fixed projection and cooperating, when said ski is being fitted, with a cavity of a part fixed to said ski, said cavity receiving said pivot in a rotatable relationship.

13. A ski-boot element according to claim 12, wherein said movable, spring-loaded piston and the spring thereof are housed in a duct in said element which slopes towards the lower plane of said element.

14. A ski-boot element according to claim 12, wherein said fixed projection extends substantially parallel with the lower plane of said element.

15. A ski-boot element according to claim 12, wherein said fixed projection is carried by the front vertical wall of the depression formed by the front part of said element, and said movable piston is arranged in the rear part of said element in order to project from the rear vertical wall of said depression.

* * * * *